US010352512B1

(12) United States Patent
Smith

(10) Patent No.: US 10,352,512 B1
(45) Date of Patent: Jul. 16, 2019

(54) DEVICE FOR ILLUMINATING A DOOR KNOB KEYHOLE

(71) Applicant: S. Lynne Smith, N. Myrtle Beach, SC (US)

(72) Inventor: S. Lynne Smith, N. Myrtle Beach, SC (US)

( * ) Notice: Subject to any disclaimer, the term of this patent is extended or adjusted under 35 U.S.C. 154(b) by 0 days.

(21) Appl. No.: 15/598,585

(22) Filed: May 18, 2017

(51) Int. Cl.

| | |
|---|---|
| ***E05B 17/10*** | (2006.01) |
| ***F21V 33/00*** | (2006.01) |
| ***F21S 9/02*** | (2006.01) |
| ***F21S 8/00*** | (2006.01) |
| ***F21V 21/096*** | (2006.01) |
| ***F21V 23/04*** | (2006.01) |
| ***F21V 23/06*** | (2006.01) |
| *F21Y 105/18* | (2016.01) |
| *F21Y 115/10* | (2016.01) |

(52) U.S. Cl.
CPC ..... *F21S 8/03* (2013.01); *E05B 17/10* (2013.01); *F21S 9/02* (2013.01); *F21V 21/096* (2013.01); *F21V 23/0464* (2013.01); *F21V 23/0471* (2013.01); *F21V 23/0485* (2013.01); *F21V 23/06* (2013.01); *F21V 33/006* (2013.01); *F21Y 2105/18* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2,765,396 | A * | 10/1956 | Iverson | E05B 17/10 200/507 |
| 3,719,821 | A | 3/1973 | Foreman | |
| 5,398,175 | A | 3/1995 | Pea | |
| 5,996,383 | A * | 12/1999 | Adelmeyer | E05B 17/10 362/100 |
| 6,132,057 | A | 10/2000 | Williams | |
| 6,293,685 | B1 | 9/2001 | Polkow | |
| 6,402,333 | B2 | 6/2002 | Gilmer | |
| 6,729,740 | B1 | 5/2004 | Gazard | |
| 7,106,172 | B2 | 9/2006 | Neveux et al. | |
| 2006/0077652 | A1 | 4/2006 | Theus | |
| 2006/0226953 | A1 | 10/2006 | Shelley et al. | |
| 2008/0296912 | A1 | 12/2008 | Whitner et al. | |
| 2011/0090077 | A1 | 4/2011 | Meyer et al. | |
| 2016/0353542 | A1 * | 12/2016 | Orr | H05B 33/0854 |

* cited by examiner

*Primary Examiner* — Ashok Patel
(74) *Attorney, Agent, or Firm* — P. Jeff Martin; The Law Firm of P. Jeffrey Martin, LLC

(57) ABSTRACT

A device for illuminating a door knob keyhole of a conventional door locking set, the device includes a ring-shaped lighting assembly. The lighting assembly is detachably secured to a face of the door knob of the conventional door locking set. The lighting assembly includes an annular base structure and a light source support, each having a central hole sized large enough to expose the keyhole when the lighting assembly is detachably secured to the door knob. The light source includes a plurality of light-emitting diodes (LEDs) which are retained in the light source support. An electrical circuit, which includes a depressible switch, is provided for activating the LEDs.

15 Claims, 20 Drawing Sheets

FIG. 5
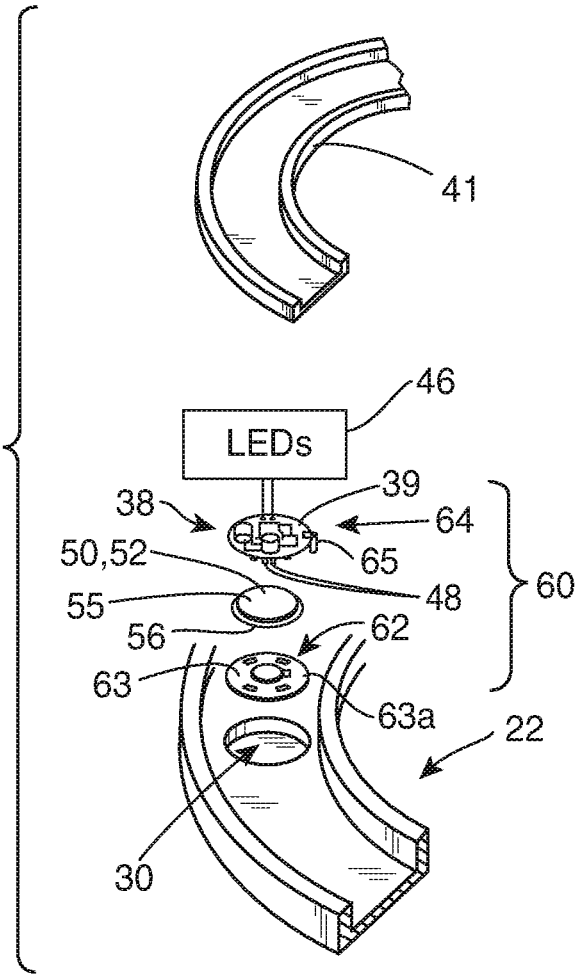
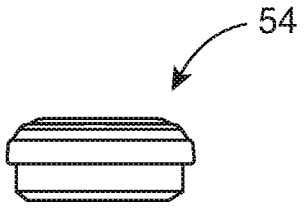
FIG. 5A

DEVICE FOR ILLUMINATING A DOOR KNOB KEYHOLE

I. RELATED APPLICATIONS

There are no previously filed, nor currently any co-pending applications, anywhere in the world.

II. TECHNICAL FIELD OF THE INVENTION

The present application describes and discloses an illuminated indicator for a key hole of a door lock.

III. BACKGROUND OF THE INVENTION

Currently there exist in the art various devices for illuminating door knobs, locks, fixtures, and other appliances. However, the prior art has failed to disclose or teach a device for illuminating a door knob keyhole of a door locking set, wherein such device is adapted and configured to be detachably secured to the face of the door knob, and which is dimensionally configured so as to shapely match and mutually correspond to the surface area measurement of the face of the door knob to which the illuminative device is desired to be detachably secured.

A search of the prior art did not disclose any patents that read directly on the claims of the instant invention; however, the following references were considered related:

U.S. Pat. No. 5,398,175, issued in the name of Pea;

U.S. Pat. No. 6,132,057, issued in the name of Williams;

U.S. Pat. No. 3,719,821, issued in the name of Foreman;

U.S. Pat. No. 6,729,740 B1, issued in the name of Gazard;

U.S. Pat. No. 6,402,333 B2, issued in the name of Gilmer;

U.S. Pat. No. 7,106,172 B2, issued in the name of Neveux et al.;

U.S. Patent Application no. 2006/0226953 A1, published in the name of Shelley et al.;

U.S. Patent Application no. 2011/0090077 A1, published in the name of Meyer et al.;

U.S. Pat. No. 6,293,685 B1, issued in the name of Polkow;

U.S. Patent Application no. 2008/0296912 A1, published in the name of Whitner et al.; and U.S. Patent Application no. 2006/0077652 A1, published in the name of Theus.

Consequently, a need has been felt for a device for illuminating a door knob keyhole having dimensional features and characteristics allowing the device to dimensionally match the face size and surface area of the selected door knob, and wherein such device is adapted and configured to be detachably secured to such door knob.

This application presents claims and embodiments that fulfill a need or needs not yet satisfied by the products, inventions and methods previously or presently available. In particular, the claims and embodiments disclosed herein describe a device for illuminating a door knob keyhole of a door locking set, the illuminative device comprising: a lighting assembly detachably secured to a face of the door knob of the door locking set, the lighting assembly comprises an annular base structure, the annular base structure includes a central hole being sized large enough to expose a keyhole of the door knob, and a light source support, the light source support comprises an annular plate, the annular plate includes a central hole being sized large enough to expose the keyhole of the door knob, and wherein the annular plate is coupled to the annular base structure; a light source which is retained in the annular plate; and an electrical circuit for activating the light source, the illuminative device of the present invention providing unanticipated and nonobvious combination of features distinguished from the products, devices, apparatuses, inventions and methods pre-existing in the art. The applicant is unaware of any product, method, disclosure or reference that discloses the features of the claims and embodiments disclosed herein.

IV. SUMMARY OF THE INVENTION

A device for illuminating a door knob keyhole of a door locking set, hereinafter, "illuminative device" is disclosed. The illuminative device comprises a lighting assembly configured for attachment to the face portion of a door knob of a conventional door locking set. In accordance to one embodiment, the lighting assembly comprises an annular base structure and a light source support. The annular base structure has a central hole. The annular base structure includes a compartment comprising an interior volume for accommodating the light source support.

The light source support comprises an annular plate which includes a receptacle for retaining a light source. According to exemplary embodiments, the light source comprises a plurality of light-emitting diodes (LEDs). Similar to the annular base structure, the annular plate comprises a central hole. In any event however, the geometric shape defining the central hole of annular plate is consistent with, or more specifically, is the same or substantially the same geometric shape defining the central hole of the annular base structure. The central hole of each the annular base structure and annular plate is large enough to expose the keyhole when the lighting assembly is affixed to the outer door knob.

In accordance to one embodiment, the annular plate may be detachably coupled to the annular base structure by slidably engaging the annular plate into the compartment of the annular base structure in a closely-fitting, contiguous relationship such that the annular plate is slidably received by the compartment of annular base structure in a close and form-fitting manner.

According to one embodiment, the annular plate may be fixedly secured to the annular base structure via a plurality of fasteners, such as screws. The screws are extended through at least two openings defined through the floor of the annular base structure and threadedly engage complementary threaded bores disposed in the lower surface of the bottom of the annular plate. Other suitable means for securely fastening the annular plate to the annular base structure can be used and are envisioned which include, but are not limited to, adhesives, snap fasteners, tabs, and other fasteners and fastening mechanisms.

The illuminative device further comprises an attachment mechanism which allows the illuminative device of the present invention to be detachably secured to the face of an outer door knob of a conventional door locking set. In accordance to one exemplary embodiment, the attachment mechanism is magnetic, thereby being attracted to any magnetically attractive surface or ferromagnetic material. In further accordance to this embodiment, the annular base structure is constructed of a magnetic material and is therefore magnetically attractive to any magnetic surface or material, such as the outer door knob of a door locking set, where the outer door knob is constructed of a ferromagnetic or magnetically attractive material.

In accordance to an alternate embodiment, the attachment mechanism comprises a thin, annular magnet secured to the lower surface of the floor of the annular base structure via a suitable securing means (e.g., fasteners, adhesive) for permanently securing or bonding the annular magnet to the lower surface of the annular base structure.

In accordance to another embodiment, the attachment mechanism comprises an adhesive carrier for securely affixing the illuminative device to the face of the outer door knob of a conventional door locking set. The adhesive carrier comprises an annular planar sheet having an upper surface coated with a first adhesive coating and a lower surface coated with a second adhesive coating. The adhesive carrier is affixed to the annular base structure by engaging the first adhesive coating against the lower surface of the floor of annular base structure. A removable release liner covers the second adhesive coating. The release liner is readily peelable from the second adhesive coating. Once the release liner is removed from the second adhesive coating, said adhesive is engaged firmly against the face of the outer door knob of the door locking set, thereby securely affixing the illuminative device thereto.

In accordance to one embodiment of the present invention, electrical circuitry mounted on a circuit board is disclosed for activating the light source, the electrical circuitry includes a power source, such as a coin cell battery, and at least one switch for selectively interconnecting the power source and the light source, the switch includes a first contact and a second contact, the first contact has an electrically conductive plate, and the second contact has a springable metal finger. At least one spring plate is mounted to the upper surface of the floor of the annular base structure. The power source has an upper terminal surface and a lower terminal surface. The power source rests flat against the upper surface of the electrically conductive plate of the first contact, making electrical contact therewith. The circuit board includes one or more electrical contacts on the underside thereof which contacts the upper terminal surface of the power source, thus bringing the electrical power source into the circuit. The finger has one end (upper end) mechanically connected to the circuit board. In a resting position, the at least one spring plate biases the annular plate upwardly, thereby maintaining the other end (lower end) of finger in a position out of contact with the first contact. Being the second contact of the switch, the finger functions to turn the light source on and off. Upon depression of the annular plate, the lower end of the finger is positioned downward and contacts an exposed annular outer peripheral edge of the upper plate surface of the electrically conductive plate of the first contact, thereby closing the switch, which enables the electrical circuit and turns on or powers the light source actuating illumination thereof.

In accordance to another embodiment, the electrical circuit includes a pressure sensor adapted for enabling the electrical circuit to activate illumination of the light source. The pressure sensor is configured to sense or detect the touch of a user's finger or to otherwise detect slight pressure applied thereagainst by the user's finger.

In accordance to another embodiment, the electrical circuit includes a photoelectric sensor configured such that the light source emits illumination only when an insufficient amount of ambient light is available. This embodiment is particularly useful for utilizing the light source of the illuminative device as a night light, such as in the presence of dim light or when it is otherwise dark.

In accordance to another embodiment, the electrical circuit includes a motion sensor configured for enabling the electrical circuit to activate illumination of the light source when the sensor detects motion.

In accordance to still another embodiment, the electrical circuit includes a sound detector configured for enabling the electrical circuit to activate illumination of the light source when the sensor detects sound or sound signals. The sound detector may be configured to detect the sound generated by the voice of the user, thereby providing a voice-activated keyhole illuminative device.

V. BRIEF DESCRIPTION OF THE DRAWINGS

FIG. 5 is a perspective exploded view of the electrical circuitry and various electrical components for activating the light source, the electrical circuitry components disposed in a recessed portion of the annular base structure;

FIG. 5A is a side elevational view of a button cell battery;

Figure 15:
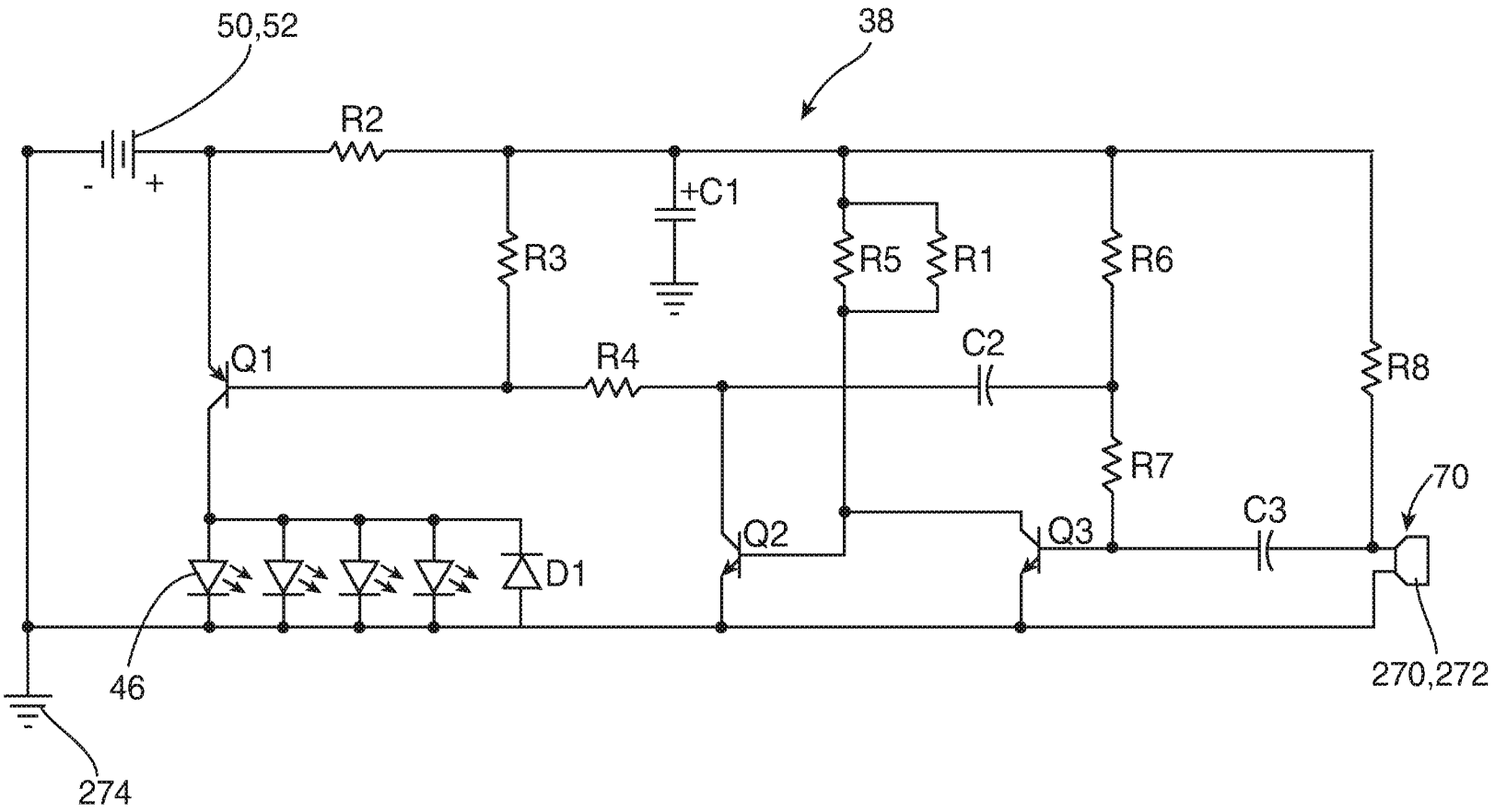
FIG. 15 is a schematic diagram of an electrical circuit used to activate the light source, the circuit includes a sensor in the form of a sound detector, in accordance to yet another embodiment of the present invention.
Figure 15A:
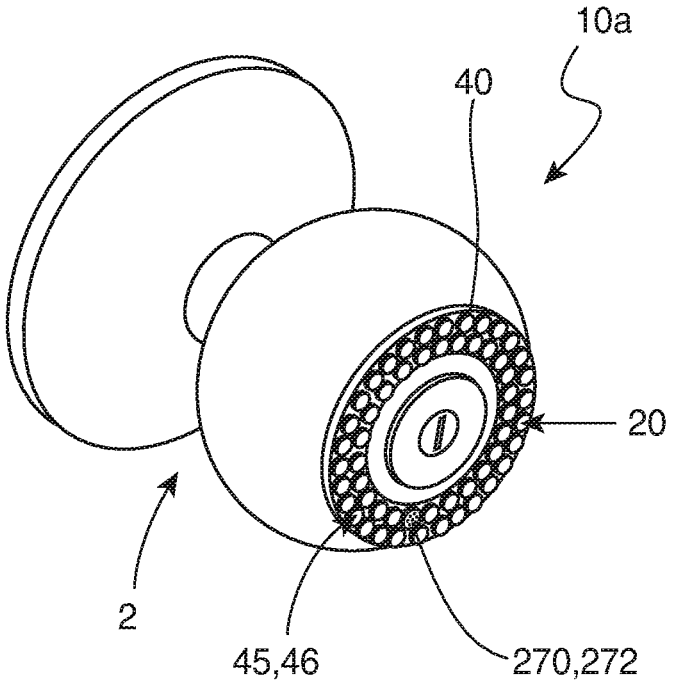
Figure 16:
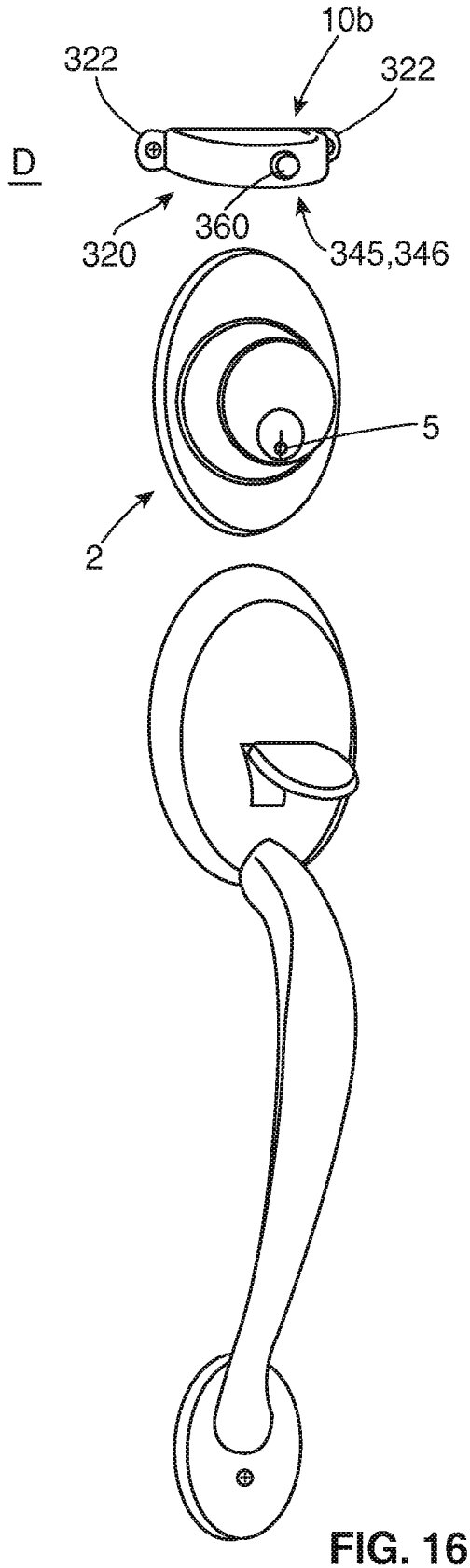

FIG. 15A is a perspective view of an illuminative device shown attached to the face of a door knob of a conventional door locking set, wherein a sound detector is shown disposed between a plurality of light-emitting diodes in the light source support of the illuminative device, in accordance to another embodiment of the present invention; and FIG. 16 is a perspective view of an alternate embodiment of the present invention shown mounted to a door.

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed, but is merely representative of selected embodiments of the invention.

Figure 1:
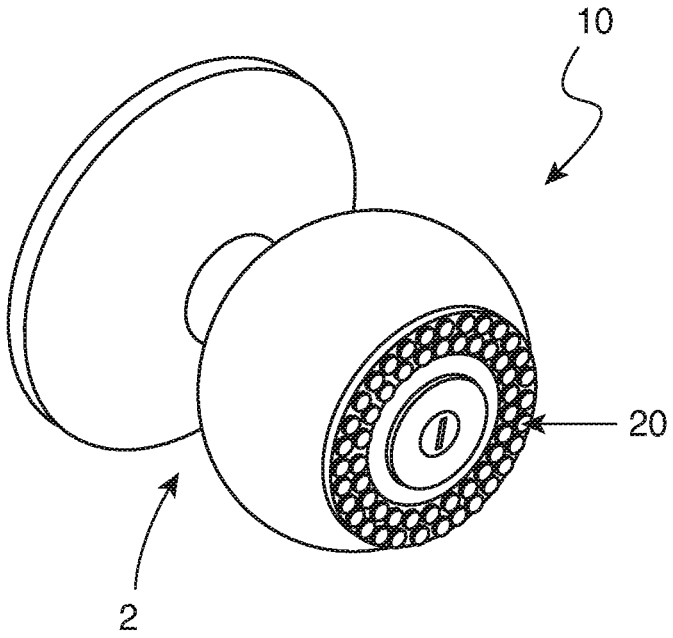
FIG. 1 is a perspective view of an illuminative device shown attached to the face of a door knob of a conventional door locking set, in accordance to one embodiment of the present invention.
Figure 1A:
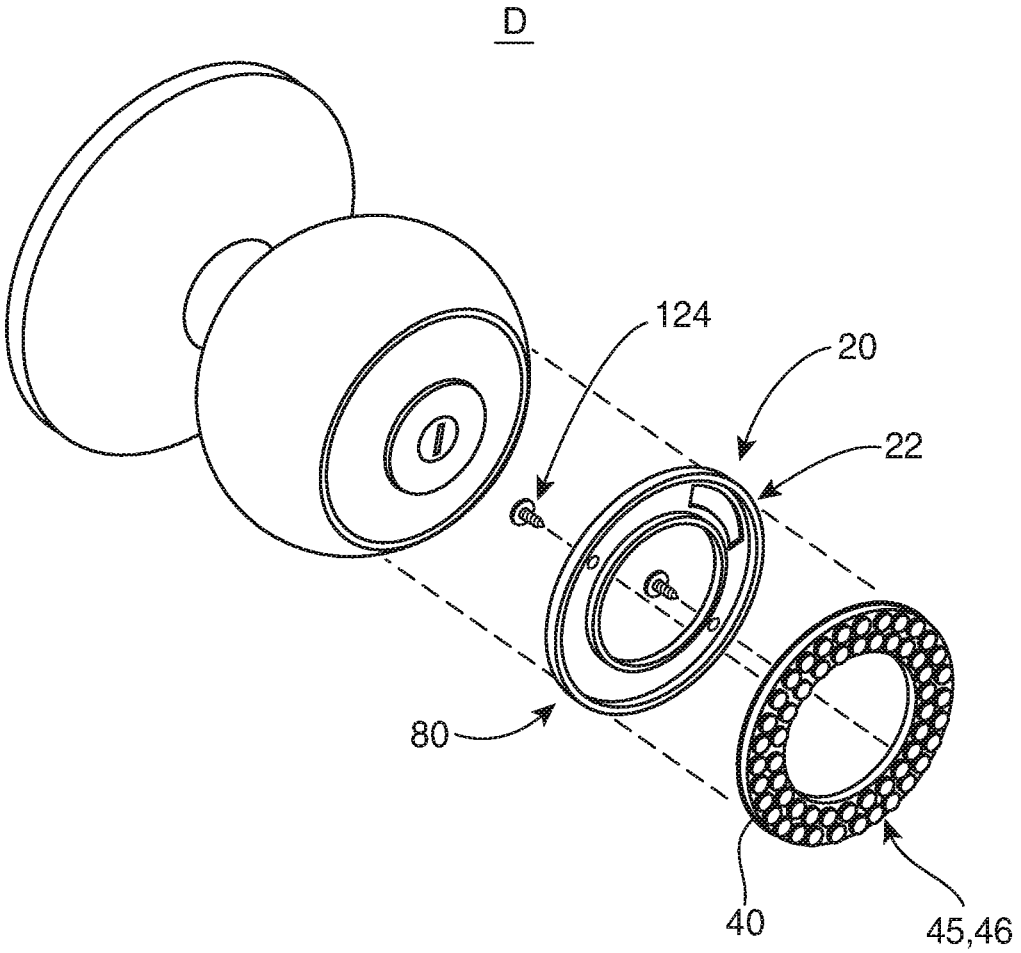
FIG. 1A is an exploded view of a lighting assembly of the illuminative device, in accordance to one embodiment of the present invention.
Figure 1B:
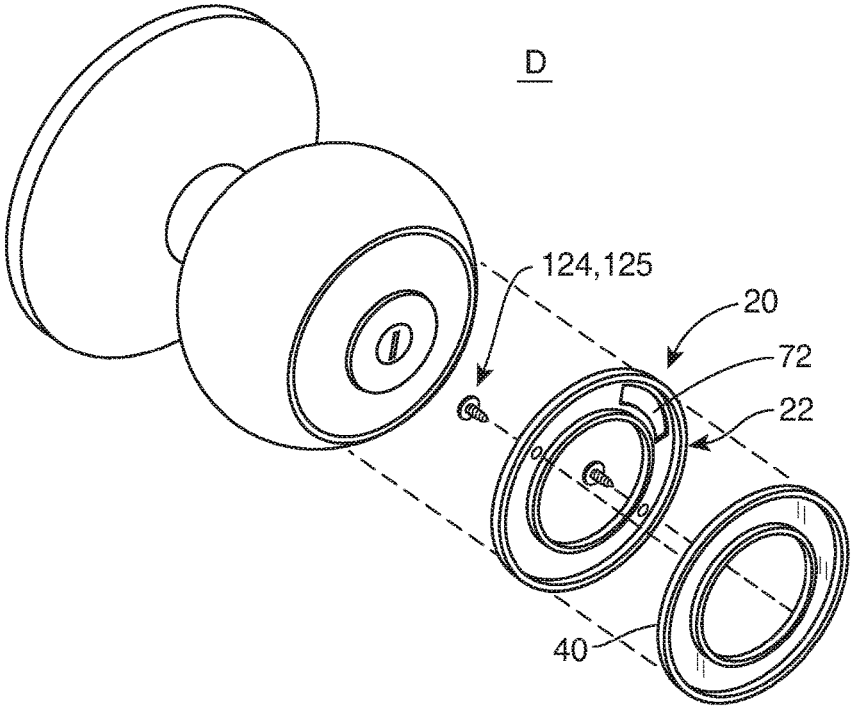
FIG. 1B is an exploded view of the lighting assembly of the illuminative device illustrating a pressure sensor disposed along the floor of an annular base structure of the lighting assembly, the light source removed from the light source support, in accordance to one embodiment of the present invention.

As depicted in FIGS. 1-1B, and in accordance with at least one embodiment envisioned herein, a device for illuminating a door knob keyhole of a door locking set, hereinafter, "illuminative device 10" is disclosed. The illuminative device 10 comprises a lighting assembly 20 configured for attachment to the face 4*aa* of a door knob 4 of a conventional door locking set 2, the door locking set 2 shown mounted to a door D. The lighting assembly 20 is dimensionally configured, or otherwise sizably adapted and configured, so as to shapely match and mutually correspond to the surface area measurement of the face 4*aa* of the outer door knob 4 to which the lighting assembly 20 is desired to be attached. This size-and-match dimensional feature is depicted in FIGS. 1 and 15A.

Figure 2:
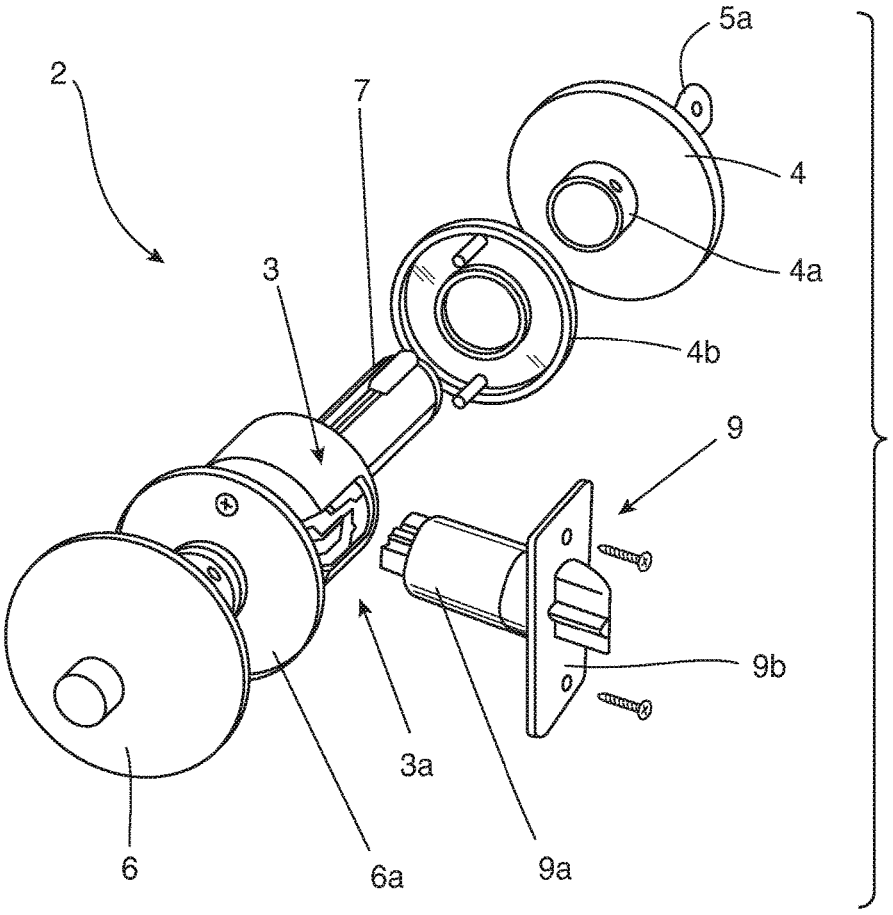
FIG. 2 Prior Art
FIG. 2 is an exploded perspective view of a conventional door locking set.
Figure 2A:
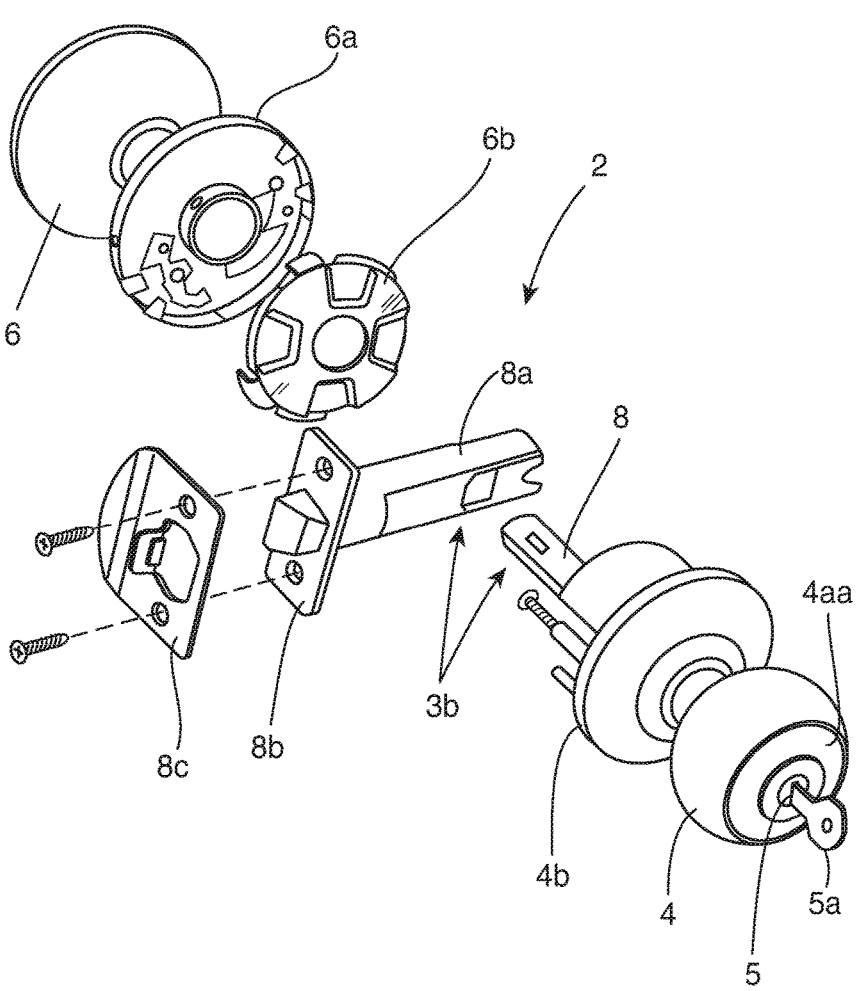
FIG. 2A Prior Art
FIG. 2A is an exploded perspective view of another conventional door locking set.

A conventional door locking set 2 typically includes a pin tumbler lock mechanism 3, such as a cylinder lock 3*a* as depicted in FIG. 2, or a spindle latch mechanism 3*b* as depicted in FIG. 2A. A door locking set 2 employing a pin tumbler mechanism 3 generally includes a cylinder 7 and a latchbolt assembly 9, the assembly 9 comprising a latchbolt 9*a* and a latchbolt faceplate 9*b*, as shown in FIG. 2. A door locking set 2 employing a spindle latch mechanism 3*b* generally includes a spindle 8 and a latch assembly 8*a*, the assembly 8*a* includes a latch faceplate 8*b* and a strike 8*c*, as illustrated in FIG. 2A. In addition to the particular locking mechanism utilized, conventional door locking sets 2 generally further include an outer knob 4 having a keyhole 5 for receiving a key 5*a*, an outer rosette 4*b*, an inner knob 6, and an inner rosette 6*a* to which a mounting plate 6*b* is coupled. The outer knob 4 may further include a shank 4*a* projecting centrally therefrom, as shown in FIG. 2.

Referring now more particularly to FIGS. 1-1B, 3-4, and 8-9A, in accordance to one embodiment, the lighting assembly 20 comprises an annular base structure 22 and a light source support 40. The annular base structure 22 has a central hole 26, the central hole 26 being large enough to expose the keyhole 5 when the lighting assembly 20 is affixed to the outer door knob 4. The central hole 26 is depicted herein as being substantially circular or oval, but other geometric shapes contemplated by those skilled in the art to define the hole 26 are envisioned and within the spirit and scope of this application. In accordance to one embodiment, the base structure 22 comprises a conical shape having a generally U-shaped cross-section. The base structure 22 comprises a floor 23 from which a first continuous sidewall 24 integrally extends upwardly therefrom forming an outer perimeter, and a second continuous sidewall 25 integrally extends upwardly from the floor 23 forming an inner perimeter. The first continuous sidewall 24 includes an upper edge 24*a*, and the second continuous sidewall 25 includes an upper edge 25*a*. The floor 23, first continuous sidewall 24, and second continuous sidewall 25 jointly form a compartment 27 comprising an interior volume 28 for accommodating a light source 45, and more particularly, the light source support 40. The floor 23 may comprise at least two openings 123 defined therethrough for receiving fasteners 124 (shown in FIGS. 1A and 1B). At least one spring plate 100 may be mounted to the upper surface 23*a* of the floor 23. In a resting position, the at least one spring plate 100 is biased upwardly from the upper surface 23*a* of floor. The function of the at least one spring plate 100 shall be described later in greater detail.

Figure 4:
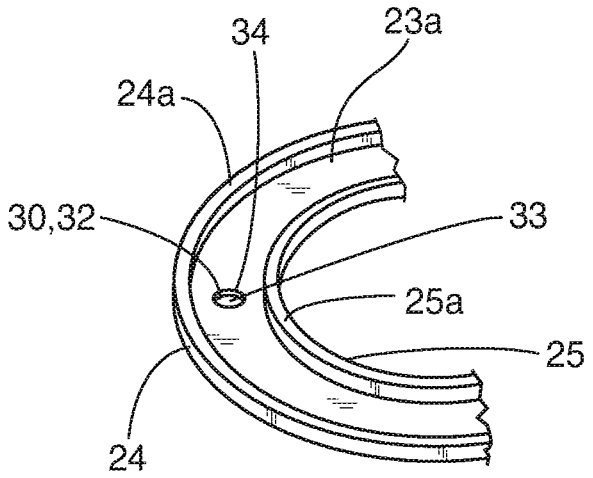
FIG. 4 is a perspective view of a section of an annular base structure illustrating a receptacle thereof for seating electrical circuitry components, in accordance to one embodiment of the present invention.
Figure 3:
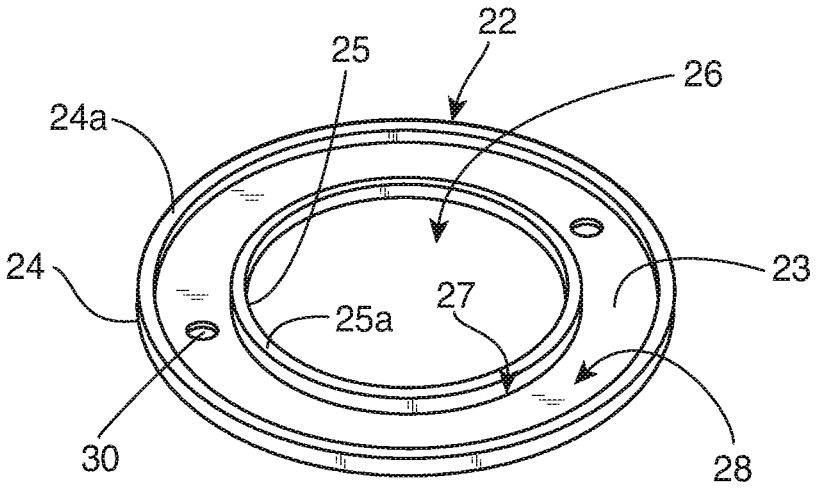
FIG. 3 is top perspective view of an annular base structure of the lighting assembly, in accordance to one embodiment of the present invention.
Figure 3A:
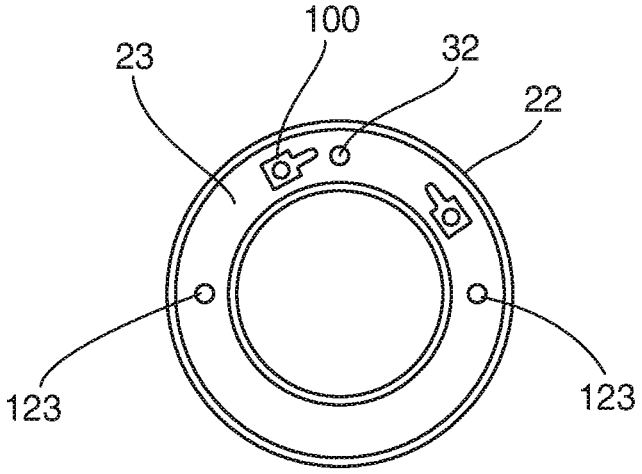
FIG. 3A is top plan view of the annular base structure, in accordance to one embodiment of the present invention.

In reference to FIG. 4, an integrally formed recessed portion 30, extending downward from the upper surface 23*a* of floor 23, provides a receptacle 32 for seating electrical circuitry components. The receptacle 32 includes a bottom wall 33 and a continuous inner circumferential sidewall 34.

Referring now more specifically to FIGS. 1A, 1B, and 8-9, the light source support 40 comprises an annular plate 41 for retaining the light source 45. The light source 45 comprises a plurality of light-emitting diodes (LEDs) 46. In accordance with other exemplary embodiments, the light source 45 may comprise at least one LED 46. The annular plate 41 comprises a central hole 41*a*. The central hole 41*a* of annular plate 41 is depicted herein as being substantially circular or oval, but other geometric shapes contemplated by those skilled in the art to define the hole 41*a* are envisioned and within the spirit and scope of this application. In any event however, the geometric shape defining the central hole 41*a* of annular plate 41 is consistent with, or more specifically, is the same or substantially the same geometric shape defining the central hole 26 of the annular base structure 22 (for example, circular or toroidal), and large enough to expose the keyhole 5.

The annular plate 41 further comprises a bottom 42 from which a first continuous sidewall 43 integrally extends upwardly therefrom forming an outer perimeter, and a second continuous sidewall 44 integrally extends upwardly from the bottom 42 forming an inner perimeter. The bottom 42 includes an upper surface 42*a* and a lower surface 42*b*. The upper surface 42*a* of the bottom 42, and the first and second continuous sidewalls 43 and 44 jointly form a receptacle 44*a* comprising an interior volume 44*b* within which the plurality of LEDs 46 are securely retained.

Figure 9A:
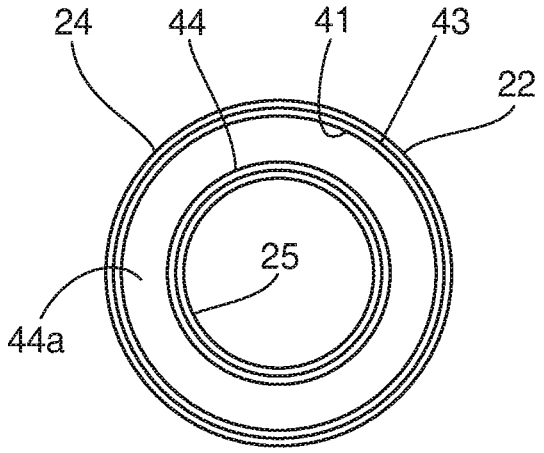
FIG. 9A is a top plan view illustrating the annular plate coupled to the annular base structure in a closely-fitting, contiguous relationship, in accordance to one embodiment of the present invention.

In accordance to one embodiment, the annular plate 41 may be coupled to the annular base structure 22 by slidably engaging the annular plate 41 into the compartment 27 of the annular base structure 22 in a closely-fitting, contiguous relationship such that the external circumferential sidewall of the receptacle 44*a* of annular plate 41 is slidably received by the compartment 27 of annular base structure 22 in a close and form-fitting manner, as best illustrated in FIGS. 1 and 9A. In order to securely fasten annular plate 41 to the annular base structure 22, a plurality of fasteners 124, such as screws 125, is extended through the at least two openings 123 in the floor 23 of base structure 22 and threadedly engage complementary threaded bores 142 disposed in the lower surface 42*b* of the bottom 42 of the annular plate 41. Other suitable means for securely fastening the annular plate 41 to the annular base structure 22 can be used, such as including, but not limited to, adhesives, snap fasteners, tabs, and other fasteners and fastening mechanisms. In accordance to other embodiments, the bottom wall 33 of the receptacle 32 of annular base structure 22 may be readily removed or opened such as via a hinge, tabs, snaps, and/or similar connectors, so as to allow quick, easy, and efficient access by user to the electronic components for purposes such as, e.g., battery removal and installation.

Referring now to FIGS. 1A and 1B, the illuminative device 10 is detachably secured to the face 4*aa* of an outer door knob 4 of a conventional door locking set 2 via an attachment mechanism 80. In accordance to one exemplary embodiment, the attachment mechanism 80 is magnetic, thereby being attracted to any magnetically attractive surface or ferromagnetic material. In further accordance to this embodiment, the annular base structure 22 is constructed of a magnetic material and is therefore magnetically attractive to any magnetic surface or material, such as the outer door knob 4 of a door locking set 2, where the outer door knob 4 is constructed of a ferromagnetic or magnetically attractive material. Ferromagnetic materials include iron, nickel, cobalt, steel, and gadolinium. The annular base structure 22 comprises a magnetic pull force operable to fixedly secure annular base structure 22, and thus the illuminative device 10, to the face 4*aa* of the outer door knob 4.

Figure 11:
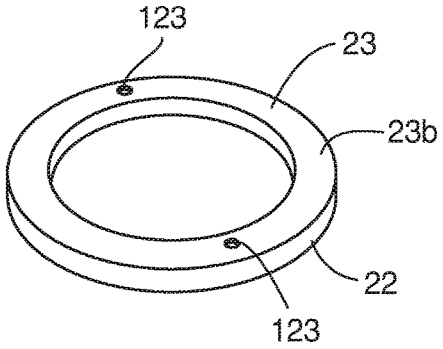
FIG. 11 is a bottom perspective view of an annular base structure showing openings defined through the floor thereof for receiving fasteners.
Figure 11A:
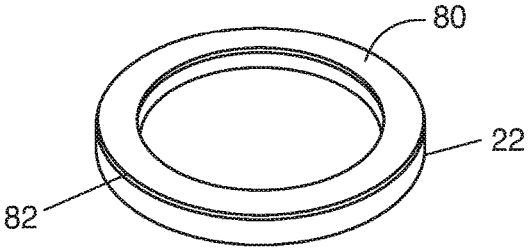
FIG. 11A is a bottom perspective view of the annular base structure to which an attachment mechanism in the form of a magnet is secured to the bottom thereof, in accordance to one embodiment of the present invention.

In reference to FIGS. 11 and 11A, and in accordance to one embodiment, the attachment mechanism 80 comprises a thin, annular magnet 82 secured to the lower surface 23*b* of the floor 23 of annular base structure 22 via an adhesive (not shown) or other suitable means for permanently securing or bonding the magnet 82 to the lower surface 23*b* of structure 22. The magnet 82 is shapely sized and configured so as to be substantially similar to, or otherwise identical to the shape and configuration of the lower surface 23*b* of the floor 23 of annular base structure 22. The magnet 82 as shown in FIG. 11A is a hard or rigid magnet (Ceramic or Ferrite magnet). In accordance to one embodiment, the annular magnet 82 may also be a flexible magnet. The use of a thin flexible magnet, as previously described, is particularly advantageous for an embodiment in which the annular base structure 22 is constructed of a non-ferromagnetic or non-magnetically attractive material, such as aluminum, plastic, or polymer material.

Figure 11B:
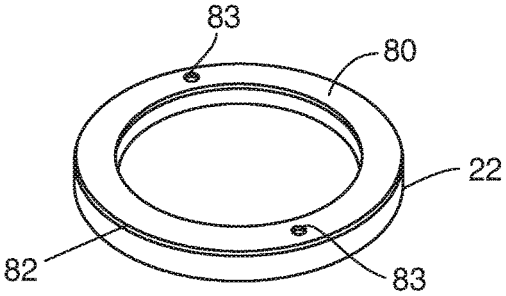
FIG. 11B is a bottom perspective view of an annular base structure to which a magnet is secured to the bottom thereof, the magnet has holes defined therethrough, in accordance to another embodiment of the present invention.

Referring now to FIG. 11B, in accordance to one embodiment, the thin, annular magnet 82 may comprise two or more holes 83 defined therethrough. The holes 83 are spaced and equal in number to the at least two openings 123 defined through floor of the annular base structure 22, thereby allowing the holes 83 of the magnet 82 to align axially with the at least two openings 123 of the floor 23 of annular base structure 22 when securing magnet 82 to the base structure 22, and thus facilitating passage of fasteners 124, such as screws 125, axially through the holes 83 of magnet 82, through the openings 123 of base structure 22 and engaging the bores 142 of the annular plate 41. The magnet 82 as illustrated in the embodiment of FIG. 11B is envisioned to be a Ceramic magnet or a flexible magnet.

The magnetic attachment means 80 may comprise a wide variety of permanent magnets including rare earth magnets, alnico magnets, ceramic magnets, and flexible magnets. Other suitable magnets for use as described hereinabove may include rare earth magnets such as Samarium Cobalt and neodymium iron classes.

Ceramic or Ferrite magnets are made of a composite of iron oxide and barium or strontium carbonate. These materials are readily available and at a lower cost than other types of materials used in permanent magnets making it desirable due to the lower cost. Ceramic magnets are produced using pressing and sintering, but are brittle and require diamond wheels if grinding is necessary. These magnets are made in different grades. Ceramic grade 1 is an isotropic grade having equal magnetic properties in all directions. Ceramic grades 5 and 8 are anisotropic grades. Anisotropic magnets are magnetized in the direction of pressing. The anisotropic method delivers the highest energy product among ceramic magnets at values up to 3.5 MGOe (Mega Gauss Oersted). Ceramic magnets possess a good balance of magnetic strength, resistance to demagnetization and low cost.

Flexible magnets are magnets made of flexible materials that are bonded with a magnetic material. Flexible magnets are advantageous in that they may be bent, coiled, twisted, or otherwise machined into almost any desired shape without depleting their magnetic field. Flexible magnets are corrosion resistant, do not need a coating, are easily machined, and may be bonded with a high magnetic energy material.

Rare earth metal magnets are composed of more expensive magnetic material. Rare earth magnets may be coated onto a flexible material, e.g., plastic or nylon, and will provide excellent magnetic strength and flexibility. These magnets can also be manufactured so as to be very thin.

Alnico magnets are made primarily from a composite of aluminum, nickel, and cobalt with small amounts of other elements added to enhance the properties of the magnet.

Alnico magnets possess excellent temperature stability, good resistance to demagnetization due to shock, but are easily demagnetized. Alnico magnets are produced by two typical methods, namely, casting or sintering. Sintering offers superior mechanical characteristics, whereas casting delivers higher energy products (up to 5.5 MGOe) and allows for the design of intricate shapes. Alnico magnets are made in different grades. Grades 5 and 8, which are anisotropic grades, are two very common grades. Anisotropic grades provide for a preferred direction of magnetic orientation. Alnico magnets have been replaced in many applications by ceramic and rare earth magnets.

Figure 11C:
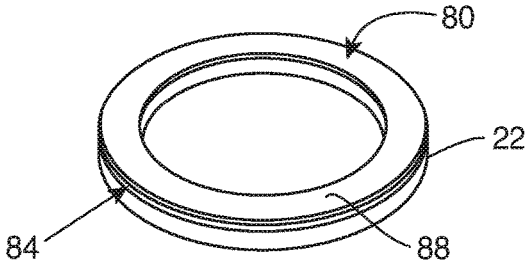
FIG. 11C is a bottom perspective view of the annular base structure showing the attachment mechanism affixed thereto, in accordance to another embodiment of the present invention.
Figure 11D:
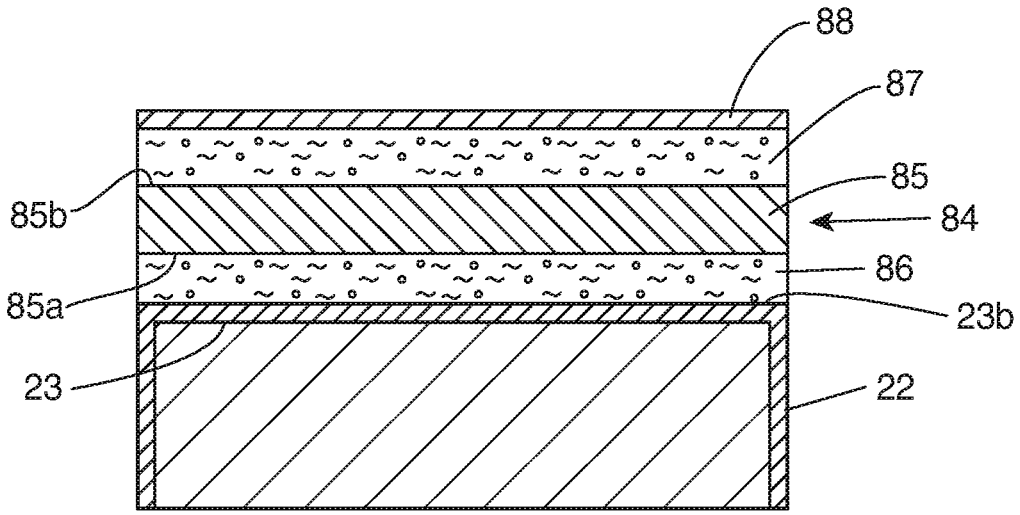
FIG. 11D is a side elevational, cross-sectional view, on an enlarged scale, of the annular base structure and attachment mechanism of FIG. 11C.

Referring now to FIGS. 11C and 11D, in accordance to another embodiment, the attachment mechanism 80 comprises an adhesive carrier 84 for securely affixing the illuminative device 10 to the face 4*aa* of an outer door knob 4 of a conventional door locking set 2. The adhesive carrier 84 comprises an annular planar sheet 85 having an upper surface 85*a* and a lower surface 85*b*. The upper surface 85*a* of planar sheet 85 is coated with a first adhesive coating 86, and the lower surface 85*b* of planar sheet 85 is coated with a second adhesive coating 87. The adhesive carrier 84 is affixed to the annular base structure 22 by engaging the first adhesive coating 86 against the lower surface 23*b* of the floor 23 of annular base structure 22. The adhesive carrier 84 is shapely sized and configured so as to be substantially similar to, or otherwise identical to the shape and configuration of the lower surface 23*b* of the floor 23 of annular base structure 22. The annular planar sheet 85 may comprise a pressure-sensitive polyethylene film or a pressure-sensitive polyurethane film.

A removable release liner 88 covers the second adhesive coating 87. The release liner 88 is readily peelable from the second adhesive coating 87. Once the release liner 88 is removed from the adhesive 87, the adhesive 87 is engaged firmly against the face 4*aa* of the outer door knob 4 of the door locking set 2, thereby securely affixing the illuminative device 10 thereto. The second adhesive coating 87 is characterized as having a degree of tackiness sufficient to hold the illuminative device 10, via the annular base structure 22, to the face 4*aa* of the outer door knob 4 of the door locking set 2.

Referring now more particularly to FIGS. 1, and 3-10, in accordance to one embodiment, the light source 45 is powered via a power source 50 operably connected electrically to an electrical circuit 38 mounted on a circuit board 39, such as a printed circuit board. The electrical circuit 38, light source 45, and associated electrical components are powered using the power source 50 comprising one or more removable, replaceable direct current (DC) batteries, such as a coin cell battery 52, a button cell battery 54, or one or more removable and rechargeable batteries, such as a lithium-ion cell battery. The power source 50 supplies voltage in the range of approximately 1.5V to 9.0V. Non-exclusive examples of rechargeable lithium-ion batteries that can be used with the teachings herein include lithium thionyl chloride, lithium manganese oxide batteries, iron disulfide, carbon monofluoride, and the like. Those possessing ordinary skill in the art can readily select an appropriate power source that is compatible with the power requirements of the selected means for activating illumination of the light source 45.

Figure 5B:
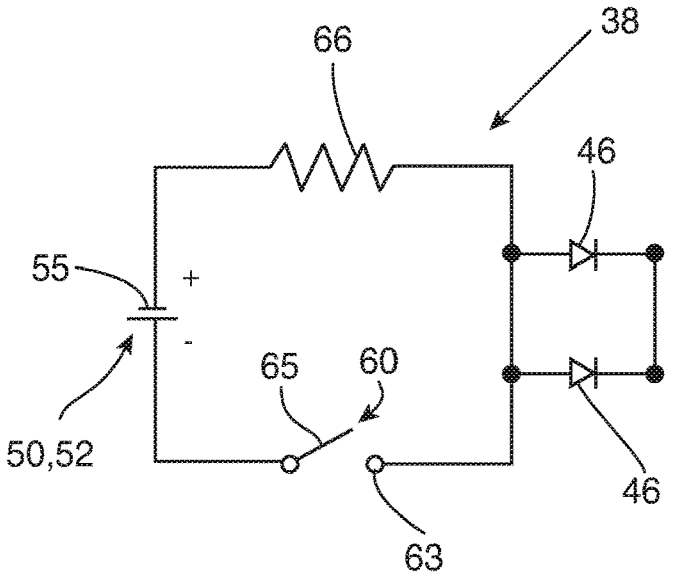
FIG. 5B is an exemplary electrical circuit diagram illustrating the light source, including the power source and the switch, in accordance to one embodiment of the present invention.
Figure 6:
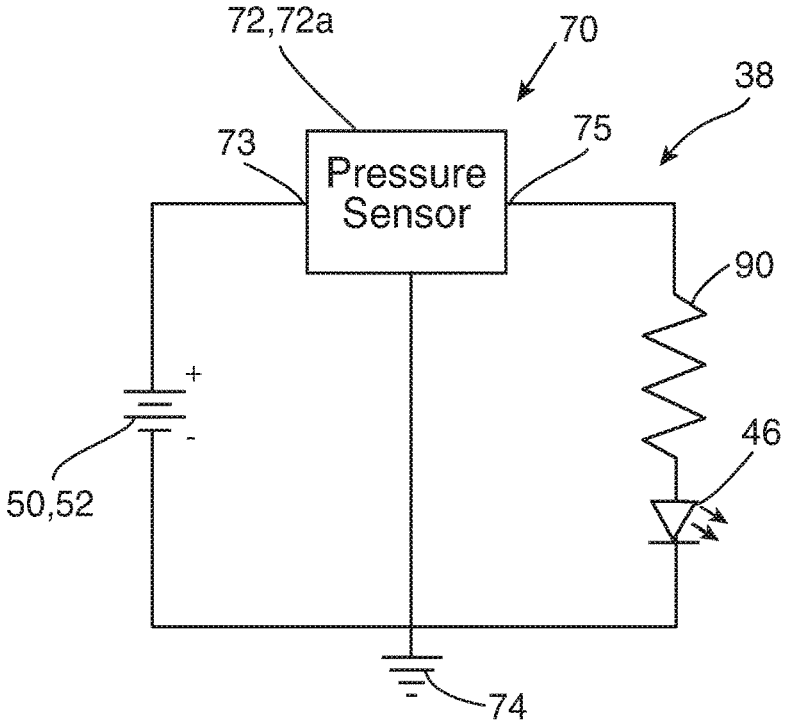
FIG. 6 is a schematic diagram of an electrical circuit used to activate the light source, the circuit includes a sensor in the form of a pressure sensor, in accordance to one embodiment of the present invention.

In accordance to one embodiment, the light source 45 comprises at least one light-emitting diode (LED) 46, as shown in the schematic diagram in FIG. 6. Preferably, light source 45 comprises a plurality of LEDs 46 connected electrically in parallel, as depicted in the schematic diagrams in FIGS. 5B and 7, and securely arranged in the receptacle 44*a* of annular plate 41 as shown in FIGS. 1 and 1A. In accordance to another embodiment, the plurality of LEDs 46 may be connected electrically in series. Each of the LEDs 46 includes a pair of leads 47 terminating into contacts 48 coupled to the circuit board 39 and projecting through an underside thereof.

Several different configurations of electrical circuits that interconnect the components and electrical circuitry of the lighting assembly 20 and light source support 40 are possible, depending upon the desired end result. For example, the electrical circuit 38 may be configured so that the LEDs 46 flash intermittently when the illuminative device 10 is powered on. Alternatively, the electrical circuit 38 may be configured so that the LEDs 46 remain illuminated for a brief period or remain illuminated until the illuminative device 10 is powered off. The electrical circuitry to accomplish either of these ends or operations is well known by persons of ordinary skill in the art.

In particular reference to FIGS. 5 and 5B, and in accordance to one embodiment, the electrical circuit 38 comprises at least one switch 60 which selectively interconnects the power source 50 and the light source 45. The at least one switch 60 comprises a first contact 62 and a second contact 64. The first contact 62 comprises an electrically conductive plate 63 disposed in the recessed portion 30, and the second contact 64 comprises a downwardly depending springable metal finger 65, the finger 65 being electrically conductive. The power source, such as a coin cell battery 52, has an upper terminal surface 55 and a lower terminal surface 56. The battery 52 rests flat against the upper surface of the electrically conductive plate 63, making electrical contact therewith. The circuit board 39 includes one or more electrical contacts on the underside thereof, the one or more electrical contacts contact the upper terminal surface 55 of the battery 52, thus bringing the electrical power source 50 into the circuit 38. The coin cell battery 52 is of smaller diameter than the electrically conductive plate 63, leaving an annular outer peripheral edge 63*a* of the upper plate surface of the plate 63 uncovered by the battery 52. The finger 65 has one end mechanically connected to the circuit board 39, and wherein the finger 65 is electrically connected into the electrical circuit 38 on the circuit board 39. In a resting position, the at least one spring plate 100 biases the annular plate 41 upwardly with respect to the floor 23 of annular base structure 22, thereby maintaining the finger 65 in a position out of contact with the first contact 62 (electrically conductive plate 63). Being the second contact 64 of the switch 60, the finger 65 functions to turn the light source 45 on and off. Upon depression of the annular plate 41, the lower end of the finger 65 is positioned downward and contacts the exposed annular outer peripheral edge 63*a* of the upper plate surface of the plate 63, thereby closing the switch 60, which enables the electrical circuit 38 and turns on or powers the LEDs 46 actuating illumination thereof. FIG. 5B is an exemplary electrical circuit diagram illustrating the electrical circuitry 38 used to activate the LEDs 46 in the embodiment shown in FIG. 5. The circuitry 38 includes a resistor 66 in series connection with the LEDs 46, the resistor 66 connected electrically between the upper terminal surface 55 of the battery 52 (voltage output) and the first LED 46.

Referring now to FIGS. 6, 7, and 12-15, in accordance to one embodiment of the present invention, the illuminative device 10 may comprise at least one sensor 70 or detector configured for enabling the electrical circuit 38 to activate illumination of the light source 45. For purposes of this disclosure, the terms "sensor" and "detector" are synonymous as used herein and are intended to be interchangeable. The one or more sensors 70 may include, but are not limited to, a tactile or pressure sensor 72, a photoelectric sensor 170, a motion sensor 76, and a sound detector 270.

Figure 7:
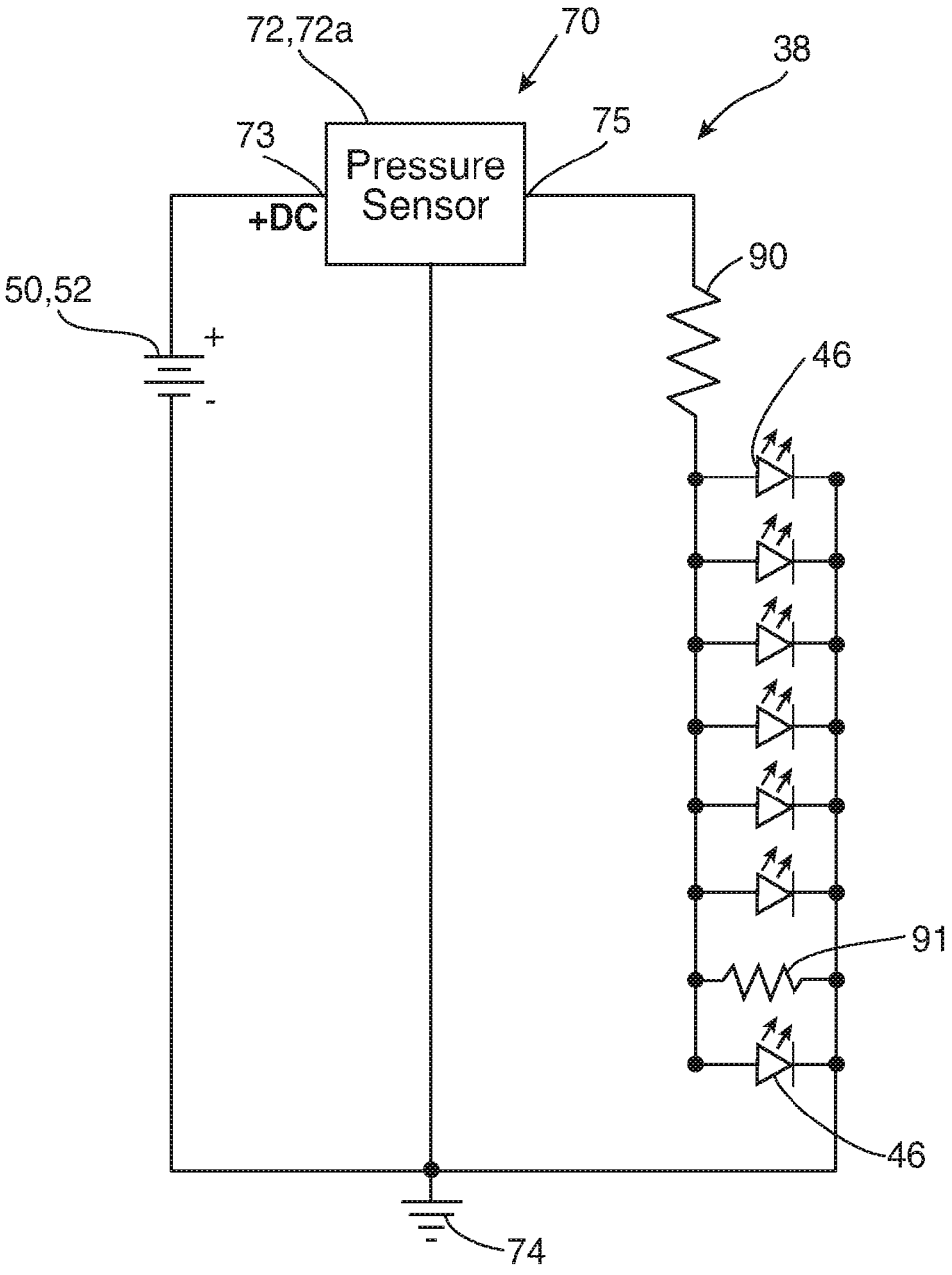
FIG. 7 is a schematic diagram of an electrical circuit used to activate the light source, the circuit includes a sensor in the form of a pressure sensor, in accordance to another embodiment of the present invention.
Figure 8:
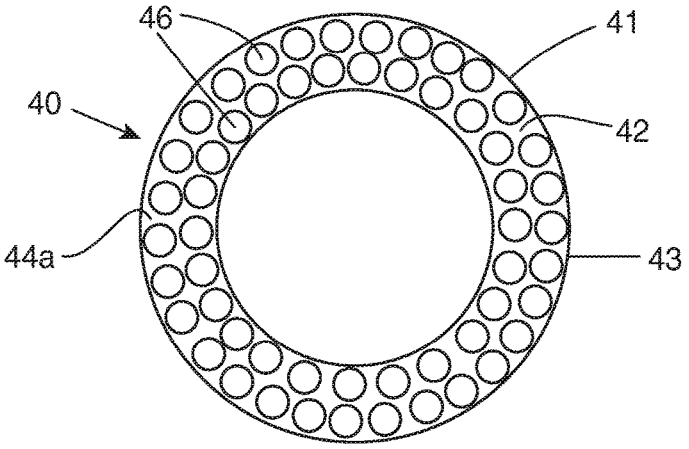
FIG. 8 is a top plan view of the receptacle of a light source support within which a plurality of light-emitting diodes are securely retained, in accordance to one embodiment of the present invention.
Figure 9:
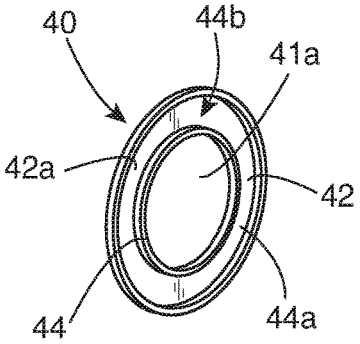
FIG. 9 is top perspective view of a light source support, in accordance to one embodiment of the present invention.

Referring now more particularly to FIGS. 1B, 6, and 7, a pressure sensor 72 configured to sense the touch of a user's finger or slight pressure applied thereagainst by the user's finger is disclosed. The pressure sensor 72 is disposed along the floor 23 of the annular base structure 22. The pressure sensor 72 is mounted to the circuit board 39 via wiring, or contacts, and is in electrical communication with the electrical circuit 38. The pressure sensor 72 acts as a switch 72*a*, wherein the switch 72*a* being normally open. The pressure sensor 72 is electrically coupled to the power source 50, the power source 50 passes DC voltage from the positive terminal thereof to pressure sensor 72 at input 73 of pressure sensor 72. The pressure sensor 72 has an output 75 from which current flows, the output 75 connected electrically to the at least one LED 46 or the plurality of LEDs 46. The pressure sensor 72 is connected to ground at ground point 74. The negative terminal of the power source 50 is connected to the ground connection of pressure sensor 72, thereby providing a return path. When pressure is detected by the pressure sensor 72, its voltage output increases actuating the pressure sensor 72 to close, thereby enabling current to pass from the sensor 72 at output 75 thereof and to the at least one LED 46 (FIG. 6) or the plurality of LEDs 46 (FIG. 7) which energizes the at least one LED 46 or plurality of LEDs 46 which energizes the LEDs 46, and actuates illumination thereof.

The electrical circuit 38 may include at least one resistor 90 in a series connection with the at least one LED 46 or the plurality of LEDs 46. The at least one resistor 90 may be further defined as a variable resistor. In reference to the electrical circuit 38 shown in FIG. 6, the resistor 90 is connected between the output 75 of pressure sensor 72 and the single LED 46. In reference to the electrical circuit 38 shown in FIG. 7, a first resistor 90 is connected between the output 75 of pressure sensor 72 and the first LED 46 of the plurality of LEDs 46, and a second resistor 91 is connected between the next-to-last LED 46 and the last LED 46 of the plurality of LEDs 46. While the electrical circuit 38 in FIG. 7 illustrates the use of two resistors 90 and 91, the electrical circuit 38 may comprise a single resistor connected at any position between the first LED 46 and the last LED of the plurality of LEDs 46. Further, the plurality of LEDs 46 in FIG. 7 is shown connected electrically in parallel. In accordance to other embodiments, the plurality of LEDs 46 may be connected electrically in series.

Thus, in accordance to the electrical circuitry 38 illustrated in both FIG. 6 and FIG. 7, when pressure is detected, the output voltage swings high and powers the single LED 46 or plurality of LEDs 46. The electrical circuitry 38 in both FIG. 6 and FIG. 7 may be configured such that after about 1 second or 2 seconds, the output swings back low and the single LED 46 or the plurality of LEDs 46 turns off until pressure is detected again. Absent applied pressure, the single LED 46 or plurality of LEDs 46 just stays in an off condition.

Figure 12:
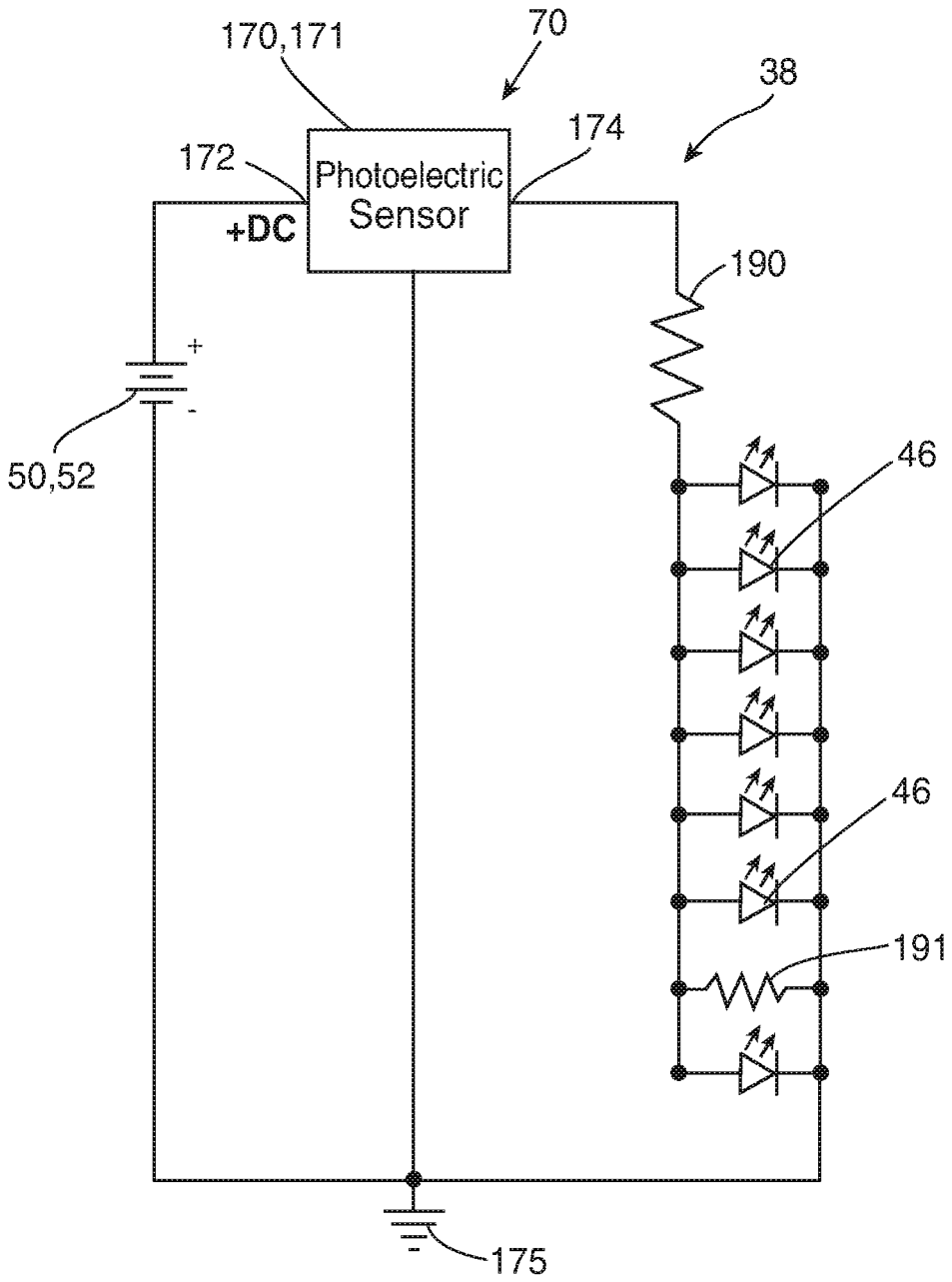
FIG. 12 is a schematic diagram of an electrical circuit used to activate the light source, the circuit includes a sensor in the form of a photoelectric sensor, in accordance to one embodiment of the present invention.

Referring now to FIG. 12, the electrical circuit 38 comprises a photoelectric sensor 170 configured such that the LEDs 46 emit illumination only when an insufficient amount of ambient light is available. This embodiment is particularly useful for utilizing the LEDs 46 of the illuminative device 10 as night lights, such as in the presence of dim light or when it is otherwise dark.

The photoelectric sensor 170 is mounted to the circuit board 39 via wiring, or contacts, and is in electrical communication with the electrical circuit 38. The photoelectric sensor 170 acts as a switch 171, wherein the switch 171 being normally open. The photoelectric sensor 170 is electrically coupled to the power source 50, the power source 50 passes DC voltage from the positive terminal thereof to photoelectric sensor 170 at input 172 of photoelectric sensor 170. The photoelectric sensor 170 has an output 174 from which current flows, the output 174 connected electrically to the at least one LED 46 or the plurality of LEDs 46. The photoelectric sensor 170 is connected to ground at ground point 175. The negative terminal of the power source 50 is connected to the ground connection of photoelectric sensor 170, thereby providing a return path. When a predetermined low light level is detected by the photoelectric sensor 170, its voltage output increases actuating the photoelectric sensor 170 to close, thereby enabling current to pass from the sensor 170 at output 174 thereof and to the plurality of LEDs 46 which energizes the LEDs 46 and actuates illumination thereof.

In further accordance to this particular embodiment, the electrical circuit 38 may include at least one resistor 190 in a series connection with the at least one LED 46 or the plurality of LEDs 46. In reference to the electrical circuit 38 illustrated in FIG. 12, a first resistor 190 is connected between the output 174 of photoelectric sensor 170 and the first LED 46 of the plurality of LEDs 46, and a second resistor 191 is connected between the next-to-last LED 46 and the last LED 46 of the plurality of LEDs 46. Further, the plurality of LEDs 46 in FIG. 12 is shown connected electrically in parallel. In accordance to other embodiments, the plurality of LEDs 46 may be connected electrically in series.

Figure 1C:
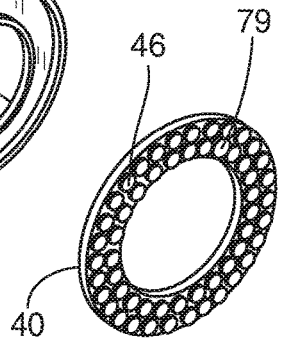
FIG. 1C is a front perspective view of the light source support showing a lens disposed between a plurality of light-emitting diodes in a receptacle portion of the light source support, in accordance to one embodiment of the present invention.
Figure 13:
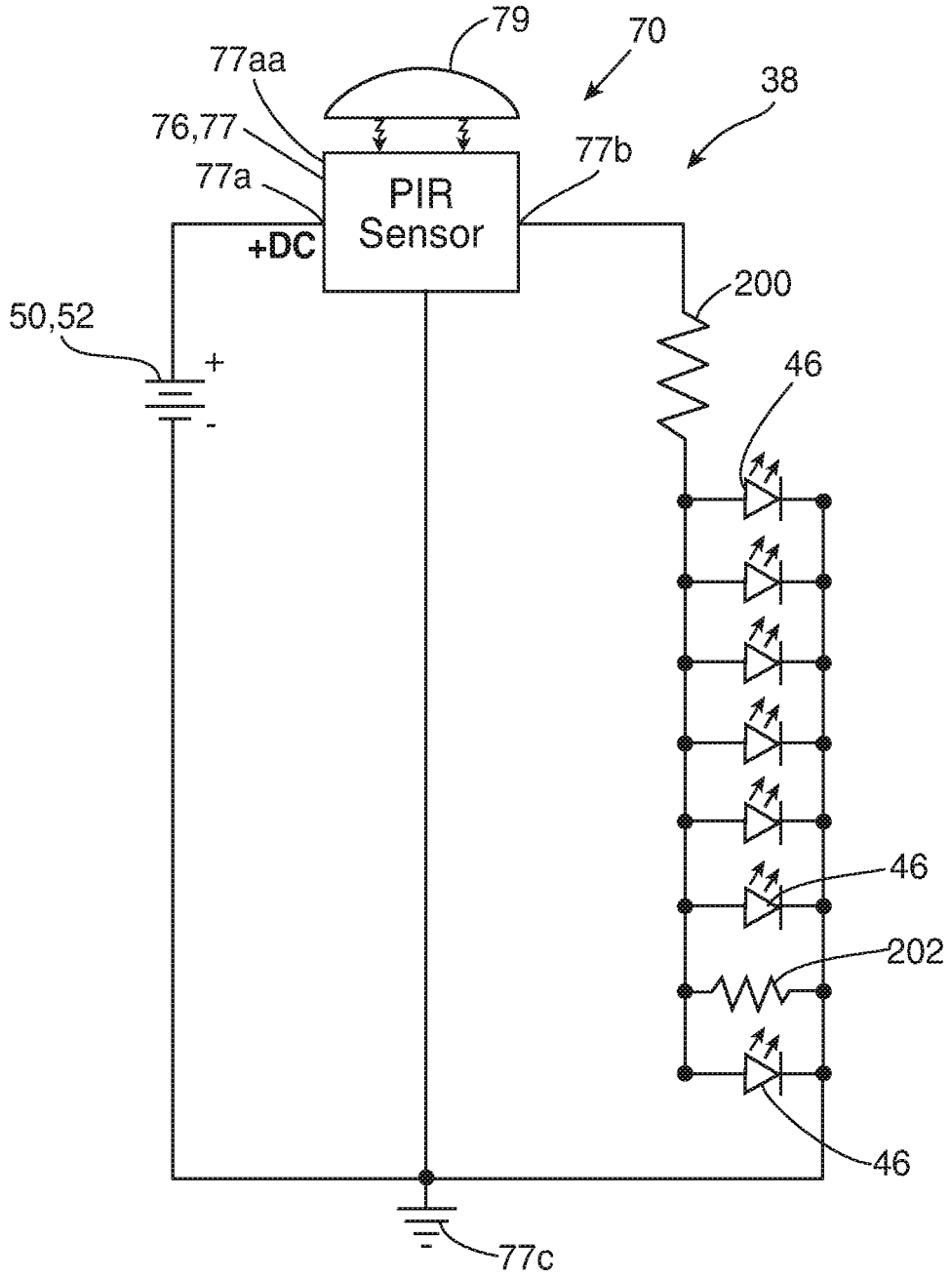
FIG. 13 is a schematic diagram of an electrical circuit used to activate the light source, the circuit includes a sensor in the form of a motion sensor, in accordance to another embodiment of the present invention.

Referring now to FIGS. 1C and 13, a motion sensor 76 configured to detect the heat emitted from a living body located within the sensor field or monitored area is disclosed. In advantageous aspects, infrared detection is sensed by a pyroelectric infrared motion sensor (PIR) 77, which is also commonly referred to as a passive infrared sensor. The PIR sensor 77 is in operable connection with a lens 79 that focuses radiated heat energy toward a focal point on the PIR sensor 77.

Various lens choices are available to customize the PIR sensor 77 to meet the preferences of the monitored area. For example, the PIR sensor 77 can be adjusted to achieve broad coverage, narrow coverage, or to allow for pet movement to prevent unintentional, repetitive, or nonessential activation of the light source 45.

One type of preferred PIR sensor lens 79 is a Fresnel lens which is readily known in the art. As shown in FIG. 1C, the lens 79 is suitably mounted between the plurality of LEDs 46 within the receptacle 44*a* of annular plate 41. In accordance to one embodiment, the lens 79 may be mounted to the upper surface 42*a* of the bottom 42 of the annular plate 41.

In advantageous aspects, the PIR sensor 77 is mounted to the circuit board 39 via wiring, or contacts, and is in electrical communication with the electrical circuit 38, which may also be mounted on circuit board 39. The PIR sensor 77 acts as a switch 77*aa*, wherein the switch 77*aa* being normally open. The PIR sensor 77 is electrically coupled to the power source 50, the power source 50 passes DC voltage from the positive terminal thereof to PIR sensor 77 at input 77*a* of PIR sensor 77. The PIR sensor 77 has an output 77*b* from which current flows, the output 77*b* connected electrically to the at least one LED 46 or the plurality of LEDs 46. The PIR sensor 77 is connected to ground at ground point 77*c*. The negative terminal of the power source 50 is connected to the ground connection of PIR sensor 77, thereby providing a return path. When motion is detected by the PIR sensor 77, its voltage output increases actuating the PIR sensor 77 to close, thereby enabling current to pass from the sensor 77 at output 77*b* thereof and to the plurality of LEDs 46 which energizes the LEDs 46 and actuates illumination thereof.

In further accordance to this particular embodiment, the electrical circuit 38 may include at least one resistor 200 in a series connection with the at least one LED 46 or the plurality of LEDs 46. In reference to the electrical circuit 38 illustrated in FIG. 13, a first resistor 200 is connected between the output 77*b* of PIR sensor 77 and the first LED 46 of the plurality of LEDs 46, and a second resistor 202 is connected between the next-to-last LED 46 and the last LED 46 of the plurality of LEDs 46. Further, the plurality of LEDs 46 in FIG. 13 is shown connected electrically in parallel. In accordance to other embodiments, the plurality of LEDs 46 may be connected electrically in series.

Because people generate body heat, they naturally emit infrared waves. The PIR sensor 77 easily detects people walking and moving through a vicinity within the sensor's 77 range. In accordance to one exemplary embodiment, the PIR sensor 77 may comprise a sensitivity range up to approximately 20 feet (6 meters) and a 110°×70° detection range, thus providing a wide lens detection sensor 77. For purposes of this disclosure, a 110°×70° detection range means the PIR sensor 77 (in conjunction with lens 79) can measure 110° vertically (from top to bottom) and 70° horizontally (from left to right).

Figure 14:
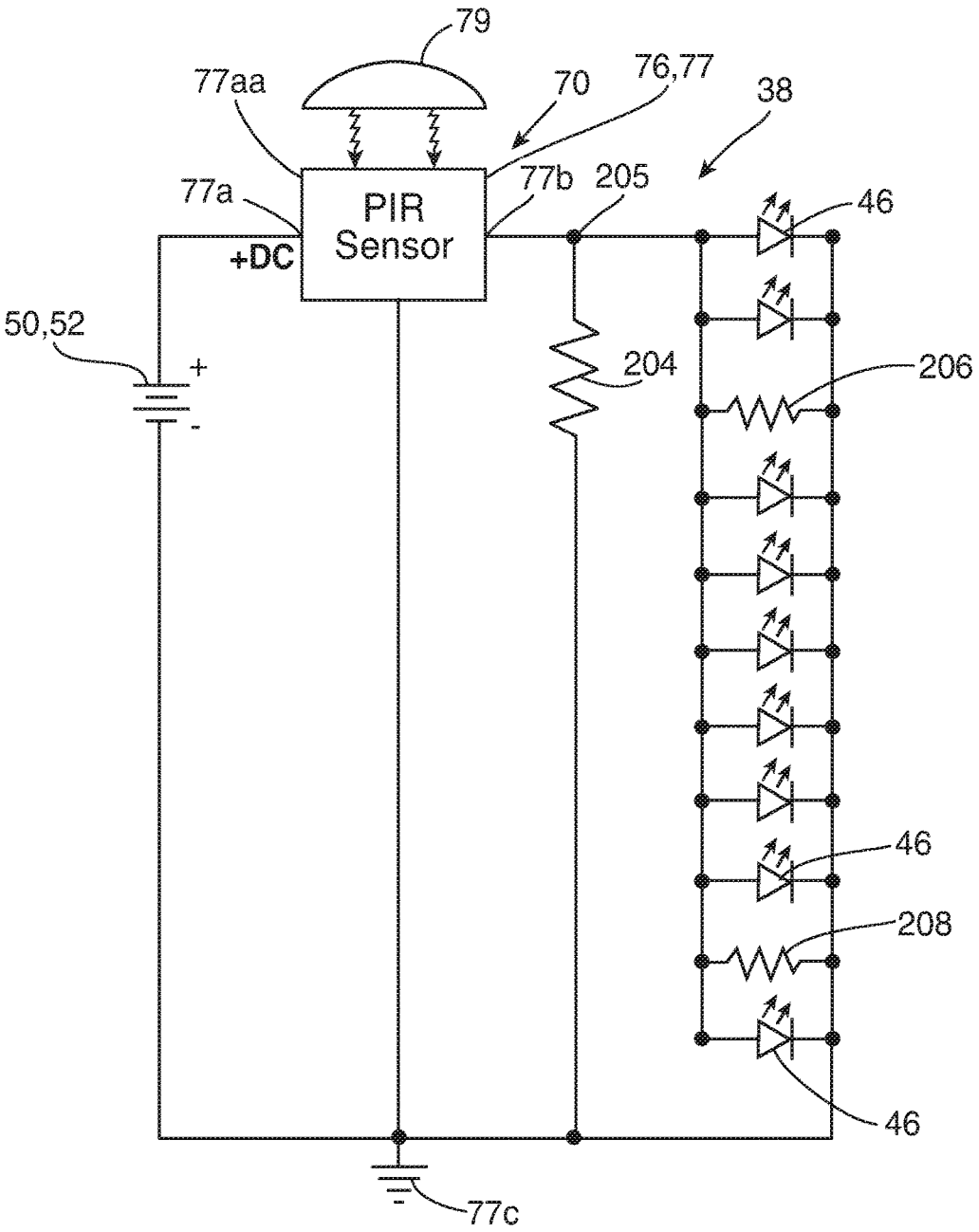
FIG. 14 is a schematic diagram of an electrical circuit used to activate the light source, the circuit includes a sensor in the form of a motion sensor, in accordance to still another embodiment of the present invention.

In reference to FIG. 14, in accordance to another embodiment, motion sensor 76 comprises a PIR sensor 77 in operable connection with a lens 79 that focuses radiated heat energy toward a focal point on the PIR sensor 77. The lens 79 may comprise a Fresnel lens.

The PIR sensor 77 may be mounted to the circuit board 39 via wiring, or contacts, and is in electrical communication with the electrical circuit 38, which may also be mounted on circuit board 39. The PIR sensor 77 acts as a switch 77*aa*, wherein the switch 77*aa* being normally open. The PIR sensor 77 is electrically coupled to the power source 50, the power source 50 passes DC voltage from the positive terminal thereof to PIR sensor 77 at input 77*a* of PIR sensor 77. The PIR sensor 77 has an output 77*b* from which current flows, the output 77*b* connected electrically to the at least one LED 46 or the plurality of LEDs 46. The PIR sensor 77 is connected to ground at ground point 77*c*. The negative terminal of the power source 50 is connected to the ground connection 77*c* of PIR sensor 77, thereby providing a return path. When motion is detected by the PIR sensor 77, its voltage output increases actuating the PIR sensor 77 to close, thereby enabling current to pass from the sensor 77 at output 77*b* thereof and to the plurality of LEDs 46 which energizes the LEDs 46 and actuates illumination thereof.

In further accordance to the embodiment illustrated in FIG. 14, the electrical circuit 38 may include a first resistor 204 connected at junction 205, wherein junction 205 is arranged between the output 77*b* of PIR sensor 77 and the first LED 46 of the plurality of LEDs 46. The first resistor 204 is connected to the ground connection 77*c* parallel to junction 205. A second resistor 206 may be connected at any position between the first LED 46 and the last LED 46 of the plurality of LEDs 46. A third resistor 208 may be connected between the next-to-last LED 46 and the last LED 46 of the plurality of LEDs 46. Further, the plurality of LEDs 46 in FIG. 14 is shown connected electrically in parallel. In accordance to other embodiments, the plurality of LEDs 46 may be connected electrically in series.

In accordance to the embodiments illustrated in FIGS. 13-14, the electrical circuitry 38 may be configured such that after the PIR sensor 77 detects motion, the LEDs 46 remain illuminated for a period of time. Thus for example, the electrical circuitry 38 may be configured such that the LEDs 46 remain illuminated for 10, 20, 30, 40, 50, or 60 seconds. Alternatively, the electrical circuitry 38 may be configured to allow the LEDs 46 to remain illuminated for a greater period of time, such as a time interval selected from a range of approximately 2 to 30 minutes, or for still a greater period of time. In other embodiments, the electrical circuitry 38 may be configured such that the LEDs 46 remain illuminated as long as the PIR sensor 77 detects movement. Thus, accordingly, the LEDs 46 will stop emitting light after a person leaves the sensor's 77 monitoring field.

Referring now to FIG. 15, a schematic diagram of an electrical circuit 38 which includes a sound detector 270 to activate the light source 45 is illustrated. The sound detector 270 detects sound or sound signals. Preferably, the sound detector 270 detects the sound generated by the voice of the user, thus providing a voice-activated keyhole illuminative device 10*a* (FIG. 15A). The sound detector 270 comprises a microphone 272, such as a high impedance microphone. As shown in FIG. 15A, the sound detector 270 (microphone 272) is suitably mounted between the plurality of LEDs 46 within the receptacle 44*a* of annular plate 41. In accordance to one embodiment, the microphone 272 may be mounted to the upper surface 42*a* of the bottom 42 of the annular plate 41, wherein the microphone 272 is connected electrically to the circuit board 39 via wiring, or contacts, and is in electrical communication with the electrical circuit 38, which may also be mounted on circuit board 39.

The electrical circuit 38 includes a power source 50, 52 which passes DC voltage from the positive terminal thereof to the emitter terminal of a positive negative positive (PNP) power transistor Q1. The light source 45 (a plurality of LEDs 46) is connected to the collector terminal of the PNP power transistor Q1. The plurality of LEDs 46 is connected to ground at ground point 274. The negative terminal of the power source 50, 52 is also connected to the ground connection 274, thereby providing a return path. The microphone 272 receives sound signals and converts the sound signals into electrical signals which are input to the base terminal of a first negative positive negative (NPN) transistor Q3. The collector terminal of a first NPN transistor Q3 is connected to the base terminal of a second NPN transistor Q2. Sound signals received by the microphone 272 cause the impedance of the microphone 272 to drop and force the first and second NPN transistors Q3 and Q2, respectively, into a non-conducting state. Current is then supplied to the plurality of LEDs 46 by the PNP power transistor Q1. As the sound signals diminish or discontinue, the microphone 272 returns to its original high impedance state and the first and second NPN transistors Q3 and Q2, respectively, begin to conduct. A higher voltage output is detected at the collector terminal of the second NPN transistor Q2, forcing the PNP power transistor Q1 into a shut-off condition, thereby turning off the LEDs 46.

The electrical circuit 38 illustrated in FIG. 15 further includes: a polarized capacitor C1 connected in series between resistors R2 and R8; a first normal capacitor C3 connected between the microphone 272 and first NPN transistor Q3; a second normal capacitor C2 connected in series to resistor R4 and parallel between resistors R6 and R7; and a diode D1 connected between the first LED 46 of the plurality of LEDs 46 and the emitter terminal of the second NPN transistor Q2. Further, the plurality of LEDs 46 in FIG. 15 is shown connected electrically in parallel. In accordance to other embodiments, the plurality of LEDs 46 may be connected electrically in series.

It is envisioned that in accordance to other embodiments, the electrical circuit 38 of the illuminative device 10 may comprise a combination of two or more sensors 70 or detectors.

Figure 10:
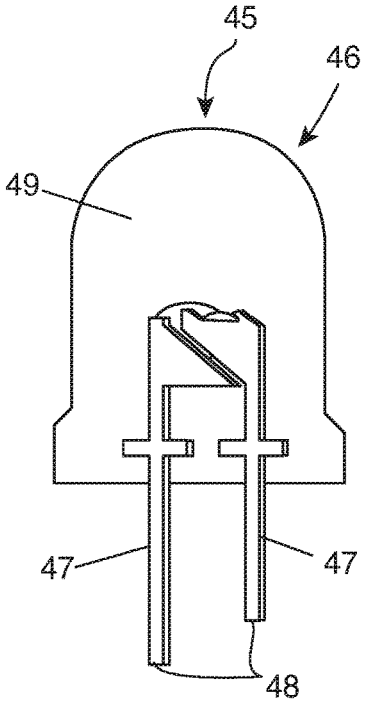
FIG. 10 is a side elevational view of a light source, in accordance to one embodiment of the present invention.
Figure 8A:
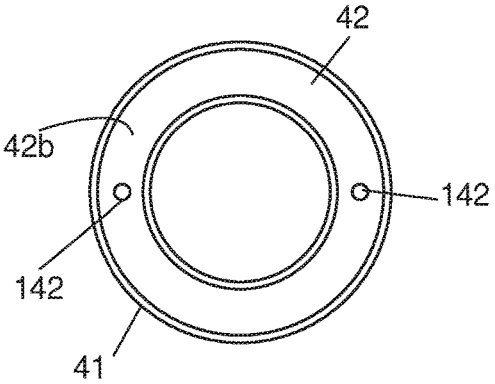
FIG. 8A is a bottom plan view of a light source support, in accordance to one embodiment of the present invention.

Referring now to FIG. 10, the LEDs 46 may each comprise a transparent or translucent semi-prolate shaped lens 49. Alternatively, the lens 49 of each of the LEDs 46 may be manufactured and made commercially available in numerous colors and color combinations, such as including, but not limited to, white, silver, green, blue, purple, red, orange, pink, amber, yellow, or gold.

Figure 10A:
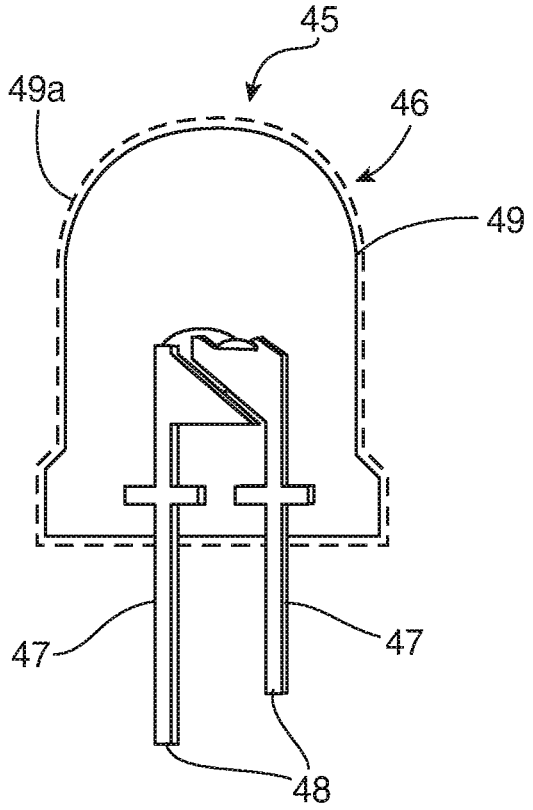
FIG. 10A is a side elevational view of the light source of FIG. 10 encapsulated with a covering, the covering shown in broken lines, in accordance to one embodiment of the present invention.

In reference to FIG. 10A, the lens 49 of each of the LEDs 46 may be covered or encapsulated with a skin or covering 49*a*, wherein the covering 49*a* is transparent or translucent. Similar to the lens described above, alternatively, the coverings 49*a* may be manufactured and made commercially available in numerous colors and color combinations, such as including, but not limited to, white, silver, green, blue, purple, red, orange, pink, amber, yellow, or gold.

Finally, in reference to FIG. 16, an alternate embodiment of the present invention is disclosed. A device for illuminating a keyhole of a door locking set 10*b* ("illuminative device 10*b*") is shown surface-mounted to a door D, proximal to a conventional door locking set 2. The illuminative device 10*b* comprises an enclosure 320 from which light is projected via alight source 345 to illuminate the keyhole 5 of the conventional door locking set 2. The enclosure 320 includes a rear wall, a front wall, a top wall, and a bottom. The enclosure 320 is shown as having a generally semi-circular shape, but other geometric shapes contemplated by those skilled in the art are envisioned and within the spirit and scope of this application.

The rear wall includes a pair of mutually opposing integral ears 322 extending linearly from respective outer ends of the rear wall. Each ear 322 includes a hole defined therethrough. Fasteners, such as screws, are extended through the holes of the ears 322 and into the surface of the door D, thereby securably mounting enclosure 320 thereto. Other suitable means for securely mounting the enclosure 320 to the door D may be utilized and are envisioned which include, but are not limited to, adhesives and other fastening mechanisms.

The bottom may comprise a translucent or transparent panel, such as a transparent acrylic lens, through which light (via the light source 345) may be transmitted relative uniformly therethrough. The light source 345 is retained within a retainer disposed above the transparent panel. Thus, the retainer is positioned in a recessed orientation with respect to the bottom. The enclosure 320 is mounted to the door D surface proximate the keyhole 5 so as to allow the light source 345 to illuminate the keyhole 5 upon activation of light source 345. The light source 345 comprises one or more LEDs 346.

The enclosure 320 houses electrical circuitry used to activate the light source 345. In accordance to one embodiment, the light source 345 is powered via a power source operably connected electrically to the electrical circuit which may be mounted on a circuit board, such as a printed circuit board. The electrical circuit, light source, and associated electrical components are powered using the power source comprising one or more removable, replaceable direct current (DC) batteries, such as a coin cell battery, a button cell battery, or one or more removable and rechargeable batteries, such as a lithium-ion cell battery.

In accordance to one embodiment of the illuminative device 10*b*, the electrical circuit comprises at least one switch which selectively interconnects the power source and the light source 345. The at least one switch may comprise a depressible button 360 disposed on the front wall of the enclosure. To activate the one or more LEDs 346, the button 360 is pressed which closes the switch, thereby enabling the electrical circuit and powering the one or more LEDs 346, actuating illumination thereof. Once the button 360 has been pressed, thereby closing the switch, user may release finger contact with the button 360 and the switch will remain in the closed state until acted upon. In order to move the switch to an open state, user simply presses the button 360 again, thereby opening the switch and deactivating the one or more LEDs 346. The electrical circuit of the illuminative device 10*b*, featuring the depressible button 360, operates and functions in the same manner and in accordance to the particular embodiment associated with the exemplary electrical circuit illustrated in FIG. 5B. Therefore, for purposes of brevity and obviating redundancy, the electrical circuit shown in FIG. 5B may be equally utilized as the electrical circuit in the immediate embodiment to activate the one or more LEDs 346, and is therefore intended to be incorporated therewith as previously described.

Several different configurations of electrical circuits that interconnect the components and electrical circuitry of the immediate embodiment of the present invention are also possible, depending upon the desired end result. For example, the electrical circuit may be configured so that the one or more LEDs 346 flash intermittently when the illuminative device 10*b* is powered on. Alternatively, the electrical circuit may be configured so that the LEDs 346 remain illuminated for a brief period or remain illuminated until the illuminative device 10*b* is powered off, such as pressing the button a subsequent time.

In accordance to another embodiment, the illuminative device 10*b* may comprise at least one sensor or detector configured for enabling the electrical circuit to activate illumination of the light source 345 (one or more LEDs 346). The one or more sensors may include, but are not limited to, a tactile or pressure sensor, a photoelectric sensor, a motion sensor, and a sound detector.

For purposes of brevity and obviating redundancy, the components and elements constituting the electrical circuitry as previously described concerning the pressure sensor, photoelectric sensor, motion sensor, and sound detector, as illustrated in FIGS. 6-7, 12, 13-14, and 15, respectively, may be equally utilized as the electrical circuitry in the immediate embodiment, respectively, to activate the one or more LEDs 346, and are therefore intended to be incorporated therewith as previously described.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A device for illuminating a keyhole of a door knob of a door locking set, the door knob having a face, the device comprises:

a lighting assembly, the lighting assembly is detachably secured to the face of the door knob of the door locking set, wherein the lighting assembly comprises:

an annular base structure, the annular base structure includes a central hole being sized large enough to expose the keyhole of the door knob;

a light source support, the light source support comprises an annular plate, the annular plate includes a central hole being sized large enough to expose the keyhole of the door knob, and wherein the annular plate is coupled to the annular base structure;

a light source, the light source is retained in the annular plate;

an attachment mechanism, the attachment mechanism detachably secures the lighting assembly to the face of the door knob of the door locking set; and an electrical circuit for activating the light source.

2. The device of claim 1, wherein the light source comprises a plurality of LEDs.

3. The device of claim 1, wherein the electrical circuit comprises a pressure sensor, the pressure sensor enables the electrical circuit to activate illumination of the light source when the pressure sensor detects slight pressure applied thereagainst by a user's finger.

4. The device of claim 1, wherein the electrical circuit comprises a photoelectric sensor, the photoelectric sensor enables the electrical circuit to activate illumination of the light source only when an insufficient amount of ambient light is detected by the photoelectric sensor.

5. The device of claim 1, wherein the electrical circuit comprises a motion sensor, the motion sensor enables the electrical circuit to activate illumination of the light source when the sensor detects motion.

6. The device of claim 1, wherein the electrical circuit comprises a sound detector, the sound detector enables the electrical circuit to activate illumination of the light source when the sensor detects sound or sound signals.

7. The device of claim 1, wherein the attachment mechanism comprises a thin, annular magnet secured to a bottom surface of the annular base structure.

8. A device for illuminating a keyhole of a door knob of a door locking set, the door knob having a face, the device comprises:

a lighting assembly, the lighting assembly is detachably secured to the face of the door knob of the door locking set, wherein the lighting assembly comprises:

an annular base structure, the annular base structure includes a central hole being sized large enough to expose the keyhole of the door knob;

a light source support, the light source support comprises an annular plate, the annular plate includes a central hole being sized large enough to expose the keyhole of the door knob, and wherein the annular plate is coupled to the annular base structure;

a light source, the light source is retained in the annular plate;

an attachment mechanism, the attachment mechanism securely affixes the lighting assembly to the face of the door knob of the door locking set; and an electrical circuit for activating the light source.

9. The device of claim 8, wherein the light source comprises a plurality of LEDs.

10. The device of claim 8, wherein the electrical circuit comprises a pressure sensor, the pressure sensor enables the electrical circuit to activate illumination of the light source when the pressure sensor detects slight pressure applied thereagainst by a user's finger.

11. The device of claim 8, wherein the electrical circuit comprises a photoelectric sensor, the photoelectric sensor enables the electrical circuit to activate illumination of the light source only when an insufficient amount of ambient light is detected by the photoelectric sensor.

12. The device of claim 8, wherein the electrical circuit comprises a motion sensor, the motion sensor enables the electrical circuit to activate illumination of the light source when the sensor detects motion.

13. The device of claim 8, wherein the electrical circuit comprises a sound detector, the sound detector enables the electrical circuit to activate illumination of the light source when the sensor detects sound or sound signals.

14. The device of claim 8, wherein the attachment mechanism comprises an adhesive carrier affixed to a bottom surface of the annular base structure.

15. The device of claim 8, wherein the electrical circuit comprises a combination of two or more sensors for enabling the electrical circuit to activate illumination of the light source.

* * * * *